US012392240B2

(12) United States Patent
Al-Dhafeeri et al.

(10) Patent No.: US 12,392,240 B2
(45) Date of Patent: Aug. 19, 2025

(54) METHOD FOR IMPROVING WELL INTEGRITY MANAGEMENT FOR GAS LIFT OIL WELLS

(71) Applicant: SAUDI ARABIAN OIL COMPANY, Dhahran (SA)

(72) Inventors: Abdullah M. Al-Dhafeeri, AlKhubar (SA); Shebl Fouad Abo Zkry, Khafji (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/682,719

(22) Filed: Feb. 28, 2022

(65) Prior Publication Data

US 2023/0272707 A1 Aug. 31, 2023

(51) Int. Cl.
*E21B 47/117* (2012.01)
*E21B 34/02* (2006.01)

(52) U.S. Cl.
CPC ..... *E21B 47/117* (2020.05); *E21B 34/02* (2013.01)

(58) Field of Classification Search
CPC ..... E21B 47/117
See application file for complete search history.

(56) References Cited

U.S. PATENT DOCUMENTS 4,030,550 A 6/1977 Mott
5,267,469 A 12/1993 Espinoza
2012/0136579 A1 5/2012 Kvernvold
2014/0214326 A1 7/2014 Samuel et al.
2016/0115784 A1 4/2016 Littleford et al.
2018/0094519 A1 4/2018 Stephens et al.
2018/0135375 A1 5/2018 Brown

FOREIGN PATENT DOCUMENTS

CN 108764729 A 11/2018
GB 2267352 A 12/1993

OTHER PUBLICATIONS

SPE 117961: Ali Al-Tamimi et al. (2008). "Design and Fabrication of a Low Rate Metering Skid to Measure Internal Leak Rates of Pressurized Annuli for Determining Well Integrity Status" (Year: 2008).*

(Continued)

*Primary Examiner* — Kristyn A Hall
(74) *Attorney, Agent, or Firm* — Osha Bergman Watanabe & Burton LLP

(57) ABSTRACT

A method for well integrity management on a well having at least one surface valve and a surface controlled sub-surface safety valve includes closing the at least one surface valve, applying a predetermined pressure to the at least one surface valve, analyzing a pressure loss across the at least one surface valve, and testing the surface controlled sub-surface safety valve for functionality. Functionality testing of the surface controlled sub-surface safety valve includes opening and closing the surface controlled sub-surface safety valve using a control panel. The method further includes classifying the well as operable or inoperable based on the pressure loss across the at least one surface valve and the functionality of the surface controlled sub-surface safety valve.

14 Claims, 7 Drawing Sheets

(56) References Cited

OTHER PUBLICATIONS

K. Corneliussen et al., "Well Integrity Management System (WIMS)—A Systematic Way of Describing the Actual and Historic intergrity Status of Operational Wells", SPE International 110347, pp. 1-8 (8 pages).
Office Action issued by the Saudi Arabian patent office for corresponding Saudi Arabian patent application No. 123441341, mailed Feb. 16, 2025 (18 pages).

* cited by examiner

METHOD FOR IMPROVING WELL INTEGRITY MANAGEMENT FOR GAS LIFT OIL WELLS

BACKGROUND

Hydrocarbon fluids such as oil and gas are produced from porous rock formations located beneath the Earth's surface. Wells are drilled into these rock formations to access the hydrocarbons. The structure of wells is made of a plurality of casing strings. The production casing string may have production tubing and equipment that may be used to help produce the hydrocarbons. A wellhead is the surface termination of the wellbore that incorporates casing hangers and various valves. A Christmas tree may be installed to the top of the wellhead to control the production of the hydrocarbons using an assortment of valves, spools, pressure gauges and chokes.

Well integrity management is the process of monitoring and maintaining the wellhead, Christmas tree, casing, and production string while the well is on production. Well integrity management uses data integration between surface and downhole parameters to identify any issues that arise. Well integrity management is an integral part of protecting the environment and the safety of individuals. Therefore, methods that effectively identify integrity and safety issues occurring in a well are beneficial.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in accordance with one or more embodiments, methods for well integrity management. A first method for well integrity management on a well having at least one surface valve and a surface controlled sub-surface safety valve includes closing the at least one surface valve, applying a predetermined pressure to the at least one surface valve, analyzing a pressure loss across the at least one surface valve, and testing the surface controlled sub-surface safety valve for functionality. Functionality testing of the surface controlled sub-surface safety valve includes opening and closing the surface controlled sub-surface safety valve using a control panel. The method further includes classifying the well as operable or inoperable based on the pressure loss across the at least one surface valve and the functionality of the surface controlled sub-surface safety valve.

A second method for well integrity management on a well having at least one casing annulus includes analyzing an annulus pressure in the at least one casing annulus, running a bleed down build up test on the at least one casing annulus, analyzing a subsequent annulus pressure after the bleed down build up test, determining a presence of fluid returns after the bleed down build up test, and classifying the well as operable or inoperable based on the annulus pressure, the subsequent annulus pressure, and the fluid returns.

A third method for well integrity management on a well having a tubing annulus includes analyzing an annulus pressure in the tubing annulus, running a bleed down build up test on the tubing annulus, analyzing a subsequent annulus pressure after the bleed down build up test, determining a presence of fluid returns after the bleed down build up test, running a communication test between the tubing annulus and a casing annulus, and classifying the well as operable or inoperable based on the annulus pressure, the subsequent annulus pressure, the fluid returns, and the communication test.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein are directed to a new method to improve well integrity management related to sustained casing pressure (SCP), tubing/casing leaks, and the well safety system and wellhead/Christmas tree. The method disclosed herein is related to identifying the integrity of the Christmas tree and wellhead assembly valves for gas lift wells in oil fields utilizing wellhead inspection and maintenance campaigns to perform remedial action plans.

Figure 1:
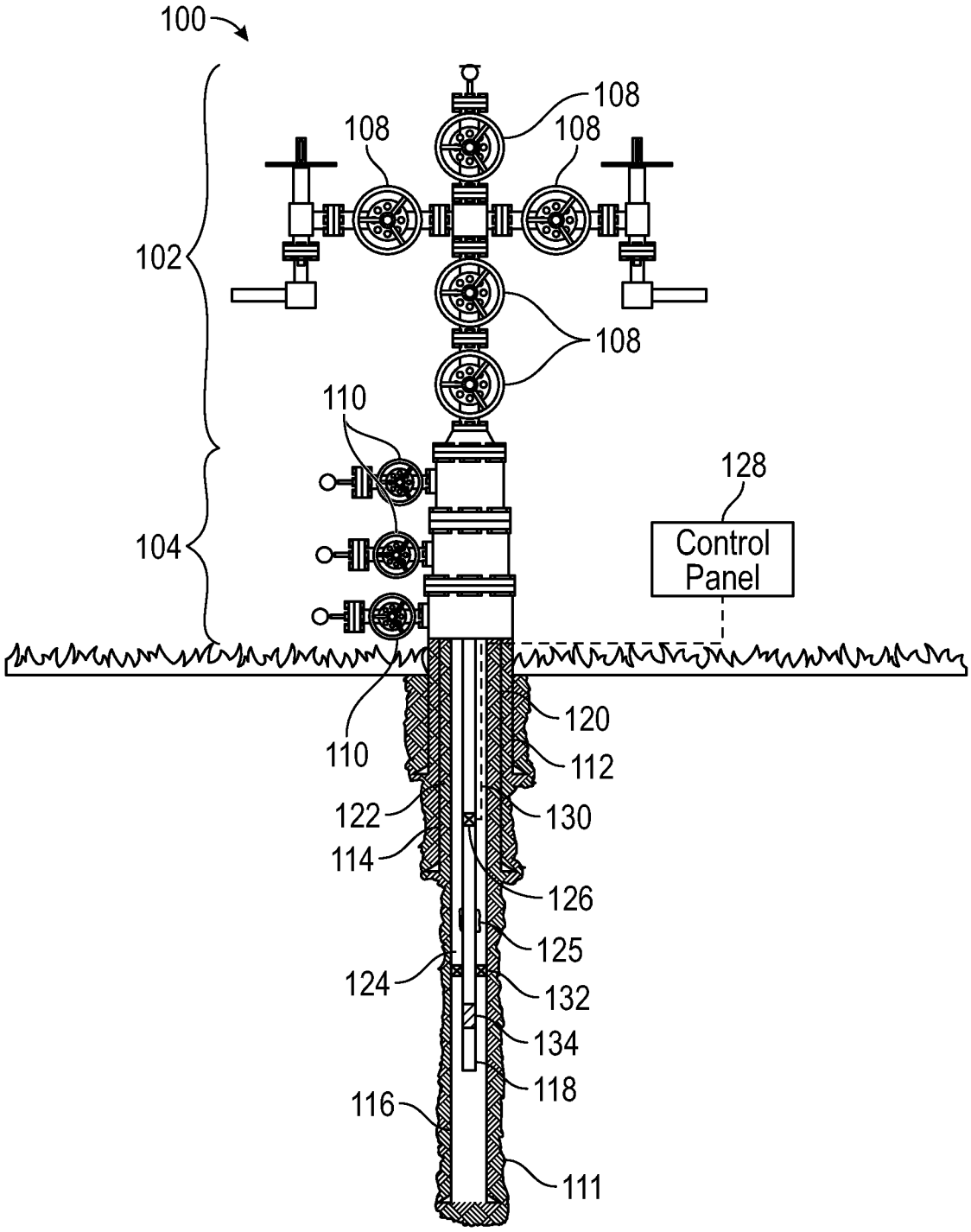
FIG. 1 shows an exemplary wellsite in accordance with one or more embodiments.

FIG. 1 depicts an exemplary well (100) in accordance with one or more embodiments. The well (100) includes a Christmas tree (102), also known as a production tree, and a wellhead (104). The Christmas tree (102) is an assembly of at least one surface valve, spools, pressure gauges, and chokes fit to the wellhead (104). The at least one surface valve on the Christmas tree (102) may be called tree valves (108) for the purposes for this disclosure. The tree valves (108) may be any kind of valve known in the art such as ball valves, butterfly valves, check valves, gate valves, etc. The tree valves (108) may be operated manually, hydraulically, or both. The tree valves (108) in FIG. 1 are depicted as manual gate valves. The tree valves (108) may be used for different purposes. For example, a tree valve (108) may be used to allow for hydrocarbons to flow from downhole to surface production equipment, such as a pipeline. The tree valves (108) may be used to inject fluids into the well (100), or they may be used to access the well (100) using completions or workover equipment.

The wellhead (104) is the surface termination of the downhole portion of the well (100) and houses casing hangers, each of which are connected to a separate casing string. The wellhead (104) further incorporates at least one surface valve used to access the annuli between casing strings. For the purposes of this disclosure, the at least one surface valve located on the wellhead (104) may be called wellhead valves (110). The wellhead valves (110) may be any kind of valve known in the art such as ball valves, butterfly valves, check valves, gate valves, etc. The wellhead valves (110) may be operated manually, hydraulically, or both. The wellhead valves (110) in FIG. 1 are depicted as manual gate valves.

The downhole portion of the well (100) is a wellbore (111) drilled into the surface of the Earth and includes all the subsurface equipment such as casing strings, production/tubing strings (118), and production/artificial lift equipment. A wellbore (111) is the open hole (or uncased) portion of the well (100), i.e., the rock face that bounds the drilled hole. The well (100) depicted in FIG. 1 is a gas lift well (100) using gas lift as an artificial lift method. The downhole portion of the well (100) is made of a surface casing (112) string, an intermediate casing (114) string, and a production casing (116) string. The casing (112, 114, 116) strings are cylindrical pipes and may be made of any material, such as steel. The well (100) further includes a production string (118) located within the production casing (116). The production string (118) is a cylindrical pipe and may be made of any material, such as steel. The production string (118) houses various valves and production equipment used to facilitate gas lift. The production string (118) has a tubing hanger (not pictured) that is set within the wellhead (104) such that the productions string (118) may be held in place. Further, the tubing hanger is made up of seals such that downhole fluids may not migrate to the surface.

A first annulus (120) exists in the space between the inner diameter of the surface casing (112) and the outer diameter of the intermediate casing (114) as well as between the exposed wellbore (111) and the outer diameter of the intermediate casing (114). A second annulus (122) exists between the inner diameter of the intermediate casing (114) and the outer diameter of the production casing (116) as well as between the exposed wellbore (111) and the outer diameter of the production casing (116). A third annulus (124) exists between the inner diameter of the production casing (116) and the outer diameter of the production string (118). The first annulus (120) and the second annulus (122) may be called the casing annuli because they exist between two casing strings, whereas the third annulus (124) may be called the tubing annulus because it exists between a casing string and a tubing/production string (118).

In a gas lift operation, gas is injected into the third annulus (124) using a wellhead valve (110). The gas enters the production string (118) through downhole valves, sometimes called gas lift mandrels (125), to lighten the downhole fluid thus "lift" the downhole fluid (hydrocarbons) to the surface. A surface controlled sub-surface safety valve (SSSV) (126) is installed beneath the wellhead (104) and within the production string (118). The SSSV (126) is a failsafe put in place to stop production of hydrocarbons by blocking the conduit within the production string (118). The SSSV (126) may be controlled using a hydraulic control line (130) which is a conduit for hydraulic fluid. The hydraulic control line (130) connects the SSSV (126) to a control panel (128) located at the surface. The surface is any location outside of the well (100) such as the Earth's surface. The control panel (128) may be hardware or software running on any suitable computing device and may also include a user interface on a display that may be accessed manually or electronically and is used to communicate with the SSSV (126). Instructions communicated from the control panel (128) may include opening the SSSV (126) or closing the SSSV (126). The control panel (128) may also provide indication of the state of the SSSV (126), i.e., that the SSSV (126) has opened or closed.

The productions string (118) may also have a production packer (132) fixed to the outer surface within the third annulus (124). The production packer (132) prevents the gas being injected into the third annulus (124) from prematurely mixing with the downhole fluids and ensures that the gas enters the production string (118) through the gas lift mandrels (125). The production sting (118) may also have a landing nipple (134). The landing nipple may be located within the productions string (118) beneath the production packer (132). The landing nipple (134) provides an interface for tools, such as a slickline plug, to set and block flow deeper (i.e., beneath the SSSV) within the production string (118).

On wells (100) such as the one depicted in FIG. 1, well integrity management is an important process applied throughout the life of the well (100). Well integrity management programs include evaluating the functionality of the surface valves (108, 110) and the SSSV (126), monitoring the pressure seen in the casing annuli (120, 122) and the tubing annulus (124), and determining if there are any leaks within or communication between the various annuli (120, 122, 124).

Embodiments disclosed herein discuss methods related to a well integrity management program. The methods include instructions on how to navigate the complexities involved in well integrity management related to sustained casing pressure, tubing or casing leaks, safety systems, and surface valves. More specifically, methods disclosed herein utilize data integration between surface and downhole parameters which are part of well integrity management in terms of monitoring programs and maintenance inspection on installed gas-lift mandrel completion wells. These methods maximize the well production potential and reduce the operation cost, leading to improvement of the well operation efficiency in order to sustain maximum production targets.

Figure 2:
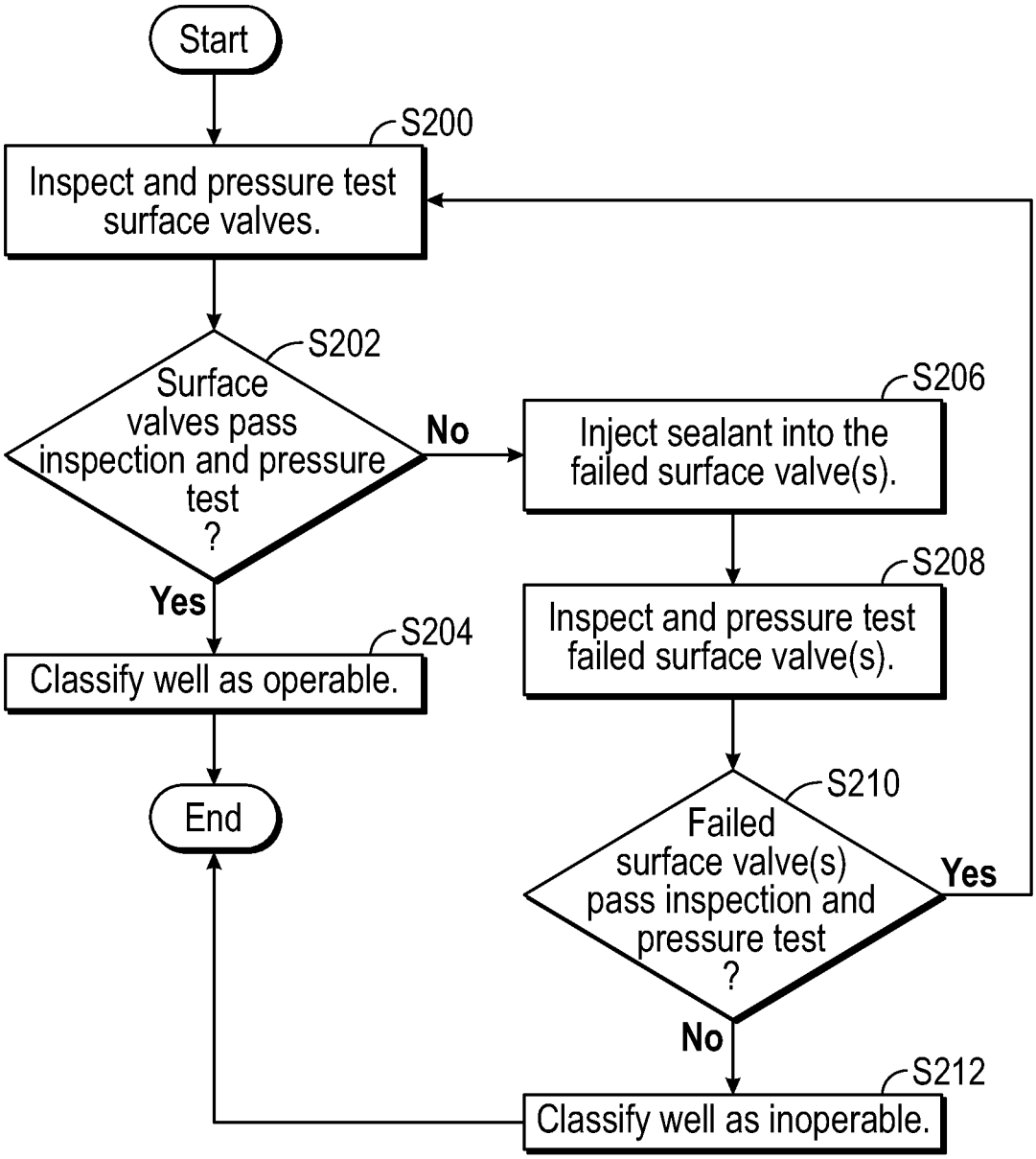
FIG. 2 shows a flowchart in accordance with one or more embodiments.

FIG. 2 depicts a flowchart in accordance with one or more embodiments. More specifically, FIG. 2 illustrates a method for determining if a well (100) is operable or inoperable based on the well's (100) surface valves (108, 110). Further, one or more blocks in FIG. 2 may be performed by one or more components as described in FIG. 1. While the various blocks in FIG. 2 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, the surface valves (108, 110) are visually inspected, and pressure tested (S200). Pressure testing of the surface valves (108, 110) begins by closing one surface valve (108, 110) and applying a predetermined pressure, such as 100 psi, to the surface valve (108, 110) for a certain amount of time, such as 10 minutes. The pressure test occurs on each surface valve (108, 110) individually. A pressure loss across the closed surface valve (108, 110) is analyzed to determine if the surface valve (108, 110) passes the pressure test. The surface valve (108, 110) passes the pressure test by having a pressure loss equal to zero psi, and the surface valve (108, 110) fails the pressure test by having a pressure loss greater than zero psi. Those skilled in the art will appreciate that the above numerical values of 100 psi and 10 minutes are merely examples, and that any suitable amount of pressure and length of time may be employed to perform the pressure test.

Visual inspection tests of the surface valves (108, 110) involve observing the visual state of the valves. The surface valve (108, 110) fails the inspection test if a deformity that may affect the function of the surface valve (108, 110) is visually detected. After all of the surface valves (108, 110) have been visually inspected and pressure tested, it is determined whether or not the surface valves (108, 110) pass the inspection and pressure test (S202). If every surface valve (108, 110) passes the inspection and pressure test, then the well (100) may be classified as operable (S204). If one surface valve (108, 110) fails the inspection and pressure test, the surface valve (108, 110) is labeled a failed surface valve (108, 110).

When testing is not passed in S202, sealant is injected into the failed surface valve(s) (S206) and the failed surface valve(s) are once again individually inspected and pressure tested to analyze a subsequent pressure loss (S208). The subsequent pressure loss across each failed surface valve (108, 110) is analyzed to determine if the failed surface valve(s) (108, 110) pass the inspection and pressure test (S210). The failed surface valve (108, 110) passes the pressure test by having a subsequent pressure loss equal to zero psi, and the failed surface valve (108, 110) fails the pressure test by having a subsequent pressure loss greater than zero psi.

If the subsequent pressure loss of every failed surface valve (108, 110) is equal to zero psi, then the method is repeated starting at S200, and all of the surface valves (108, 110) are visually inspected, and pressure tested again to ensure full functionality. If just one failed surface valve (108, 110) has a subsequent pressure loss greater than zero psi, then the well (100) is classified as inoperable (S212).

If the well (100) is classified as inoperable at this stage of the well integrity management program, the methods outlined below (and outlined in FIGS. 3-5) may still be performed on the well (100) to determine if anything else in the well (100) needs to be repaired. Even if the well (100) is deemed operable in the methods outlined below, the well (100) must still be put offline and labeled as "inoperable" until the failed surface valve(s) (108, 110) is/are repaired. If the well (100) is classified operable at this stage of the well integrity management program, the well (100) continues to the methods outlined below to determine if the remainder of the well (100) is also in operable conditions.

Figure 3:
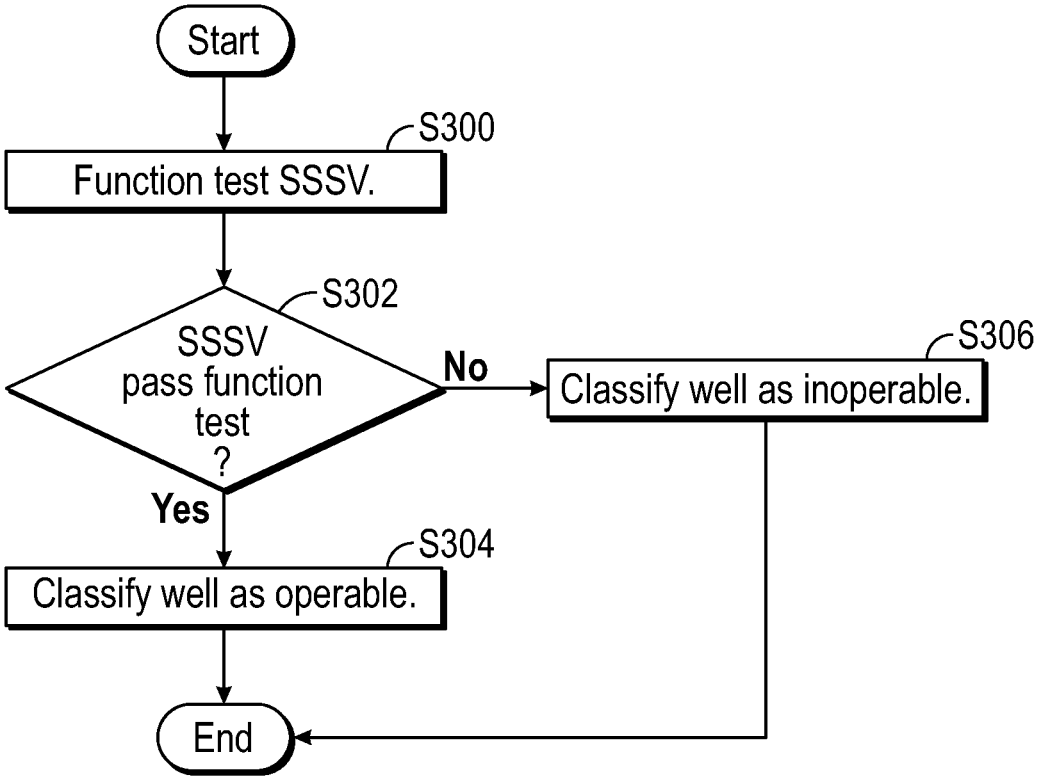
FIG. 3 shows a flowchart in accordance with one or more embodiments.

FIG. 3 depicts a flowchart in accordance with one or more embodiments. More specifically, FIG. 3 illustrates a method for determining if a well (100) is operable or inoperable based on the well's (100) SSSV (126). Further, one or more blocks in FIG. 3 may be performed by one or more components as described in FIG. 1. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, the SSSV (126) is function tested (S300) using the control panel (128). The SSSV (126) is tested for full functionality by opening and closing the SSSV (126). The SSSV (126) is open and closed by sending an instruction, using the control panel (128), to the hydraulic control line (130) which opens or closes the SSSV (126) using hydraulic fluid. It is then determined if the SSSV (126) passes the function test (S302).

The SSSV (126) passes the function test, i.e., has full functionality, when the SSSV (126) is able to fully open and fully close under instructions from the control panel. The control panel (128) may have indications that show if the SSSV (126) fully opened and closed. If the SSSV (126) passes the function test, then the well (100) may be classified as operable (S304). The SSSV (126) fails the function test, i.e., does not have full functionality, if the SSSV (126) is not able to fully open and close. If the SSSV (126) is not able to fully open and close, then the SSSV (126) may be stuck open, stuck closed, and/or there is a leak in the hydraulic control line (130). No matter the cause, if the SSSV (126) fails the function test, then the well (100) is classified as inoperable (S306).

If the well (100) is classified as inoperable at this stage of the well integrity management program, the methods outlined below (and outlined in FIGS. 4 and 5) may still be performed on the well (100) to determine if anything else in the well (100) needs to be repaired. Even if the well (100) is deemed operable in the methods outlined below, the well (100) must still be put offline and labeled as "inoperable" until the SSSV (126) is repaired. If the well (100) is classified operable at this stage of the well integrity management program, the well (100) continues to the methods outlined below to determine if the remainder of the well (100) is also in operable conditions.

Figure 4:
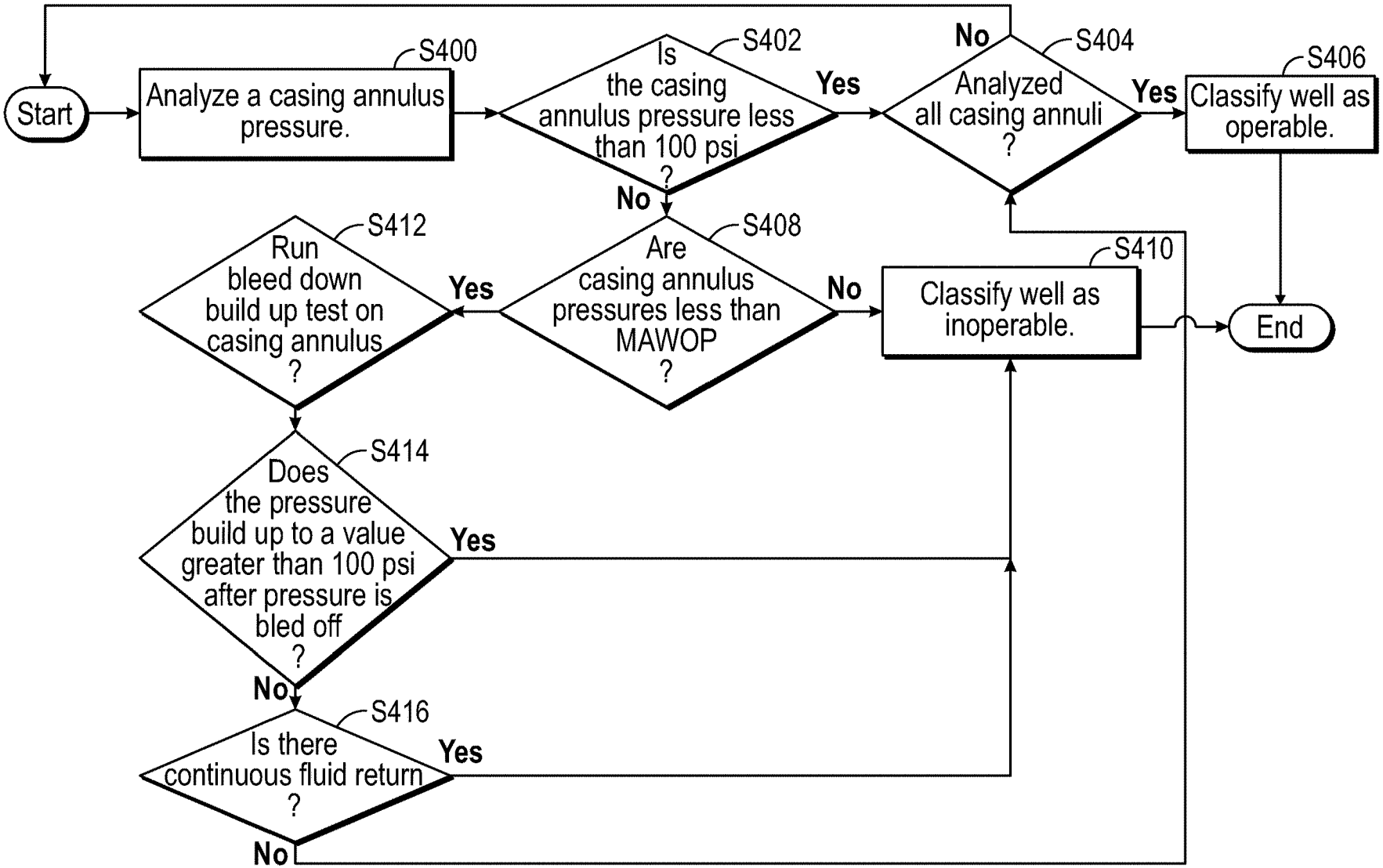
FIG. 4 shows a flowchart in accordance with one or more embodiments.

FIG. 4 depicts a flowchart in accordance with one or more embodiments. More specifically, FIG. 4 illustrates a method for determining if a well (100) is operable or inoperable based on the well's (100) casing annuli. Further, one or more blocks in FIG. 4 may be performed by one or more components as described in FIG. 1. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a casing annulus pressure is analyzed (S400). The casing annulus pressure may be analyzed by determining if the casing annulus pressure is less than an error pressure (S402). Ideally, a casing annulus pressure would read zero psi to indicate there are no leaks occurring.

However, there are many factors, unrelated to a casing leak, that may affect the readings of the casing annulus pressure, such as tool sensitivity. Thus, a range, or error pressure, may be used to allow for these factor affects. In industry, 100 psi is commonly used as an error pressure, meaning that if a casing annulus pressure reads any value less than 100 psi, the casing annulus pressure may be interpreted as reading zero psi. However, any value may be used as the error pressure without departing from the scope of this disclosure.

If the casing annulus pressure is less than the error pressure, then that casing annulus is deemed operable, and the remainder of the casing annuli may be analyzed (S404). If all of the casing annuli have been analyzed and all casing annuli are deemed operable then the well (100) may be classified as operable (S406). For the example well (100) depicted in FIG. 1, the first annulus (120) and the second annulus (122) may be considered the casing annuli that may be analyzed using the flowchart depicted in FIG. 4. If the first annulus (120) and the second annulus (122) have casing annulus pressures less than the error pressure, then the well (100) may be considered operable.

If the casing annulus being analyzed has a casing annulus pressure greater than the error pressure, then the casing annulus pressure may be further analyzed by determining if the casing annulus pressure is less than the maximum allowable working operating pressure (MAWOP) (S408). The MAWOP is the maximum pressure that the weakest component of a pressure vessel can handle before failure. The MAWOP range is linked to many factors including the well producing fluid type. In accordance with one or more embodiments, the MAWOP may be 85% of the wellhead (104) pressure rating. The MAWOP depends on the surface equipment used and the surface equipment is selected based off of the estimated production pressures. For example, if the well (100) is producing from a higher-pressure formation, then higher rated surface equipment having a higher MAWOP may be used on the well (100). If the casing annulus pressure is greater than the MAWOP, then the well (100) may be classified as inoperable (S410), and the well (100) should immediately be secured and put offline. For example, if the first annulus (120) or the second annulus (122) has a casing annulus pressure greater than the MAWOP, then the well (100) may be considered inoperable.

Figure 6:
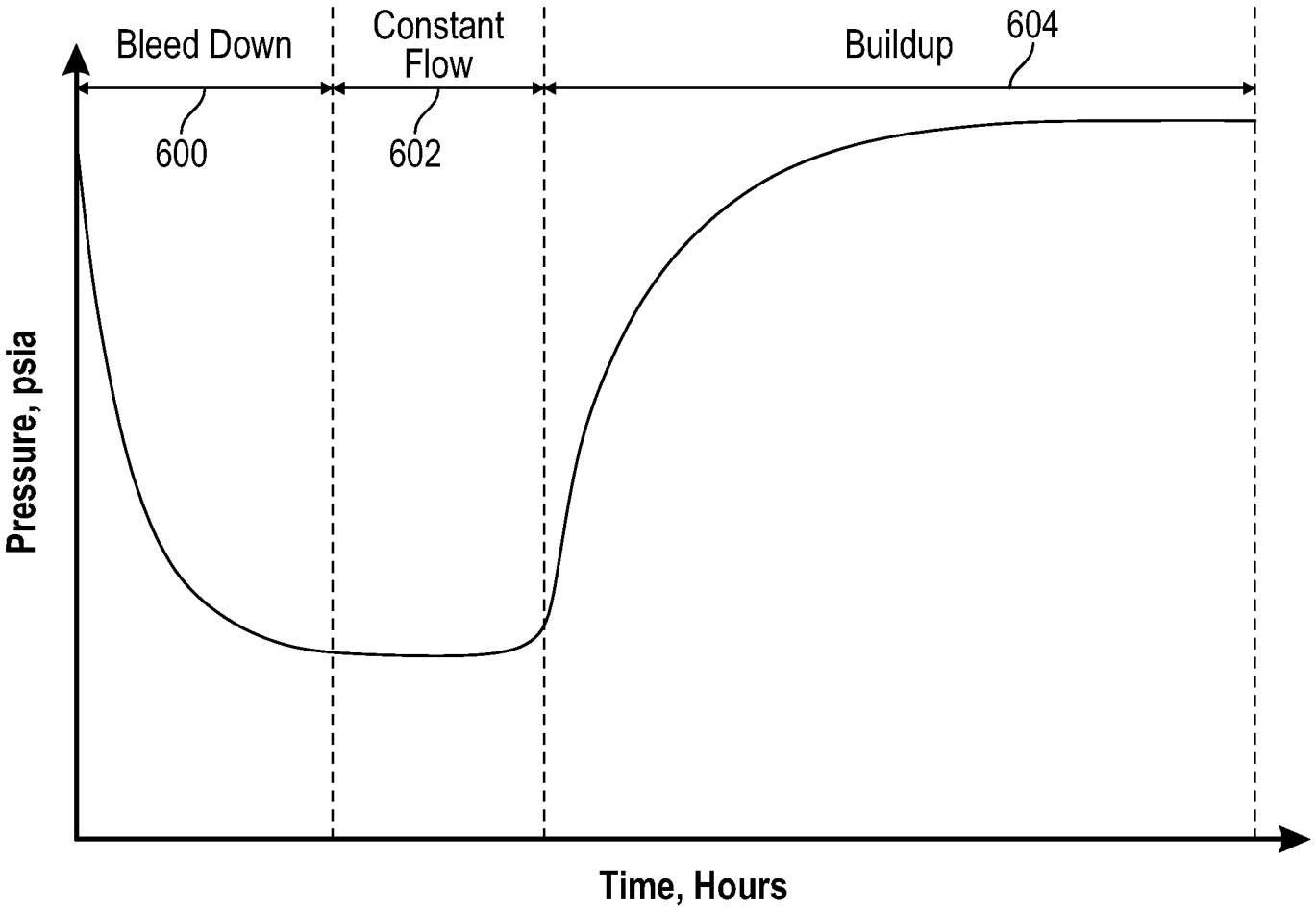
FIG. 6 shows a graph of the results from a bleed down build up test in accordance with one or more embodiments.

If the casing pressure is less than the MAWOP and greater than the error pressure (e.g., 100 psi), then a bleed down build up test may be run on the casing annulus (S412). FIG. 6 depicts a graph showing, in one or more embodiments, the results of a bleed down build up test run on a casing annulus. FIG. 6 plots pressure in psi vs time in hours during a bleed down build up test. The bleed down build up test may have three phases including a bleed down phase (600), a constant flow phase (602), and a buildup phase (604). The bleed down phase (600) consists of bleeding the pressure from the casing annulus. The constant flow phase (602) defines the period of time where the pressure in the casing annulus remains constant. The buildup phase (604) defines the period of time where the pressure in the casing annulus builds up to a certain value over a certain period of time.

The pressure in the casing annulus that is seen after the bleed down phase (600) may be called the subsequent pressure. The subsequent pressure may be analyzed to determine if the subsequent pressure builds up to a value greater than 100 psi after the pressure has been bled off (S414). If the subsequent pressure builds up to a value greater than 100 psi during the buildup phase (604), then the well (100) may be classified as inoperable (S410). If the subsequent pressure in the casing annulus does not build up to a value greater than 100 psi, then the casing annulus is further analyzed by determining if there is a presence of continuous fluid returns coming from the casing annulus (S416). If there is a presence of continuous fluid returns coming from the casing annulus, then the well (100) may be classified inoperable (S410). Fluid samples may then be taken from the fluid returns and analyzed to determine where the leak is coming from. If there are no fluid returns coming from the casing annulus, then the well (100) may be classified as operable (S406).

For example, if the first annulus (120) has a casing annulus pressure of 300 psi, the casing annulus pressure may be bled down to zero psi during the bleed down phase (600). The pressure may be bled by opening a ½ inch needle valve connected to the first annulus (120). The subsequent pressure may stay at a value around zero psi for one hour during the constant flow phase (602). The subsequent pressure may then begin to build back up to 300 psi over 12 hours during the buildup phase (604). In this scenario, the first annulus (120) sees a rise in the subsequent pressure to a value above 100 psi making the well (100) inoperable. If one casing annulus is inoperable then the whole well (100) may be classified as inoperable, even if other casing annuli were operable.

If the well (100) is classified as inoperable at this stage of the well integrity management program, the method outlined below (and outlined in FIG. 5) may still be performed on the well (100) to determine if anything else in the well (100) needs to be repaired. Even if the well (100) is deemed operable in the method outlined below, the well (100) must still be put offline and labeled as "inoperable" until the casing annuli are repaired. If the well (100) is classified operable at this stage of the well integrity management program, the well (100) continues to the method outlined below to determine if the remainder of the well (100) is also in operable conditions.

Figure 5:
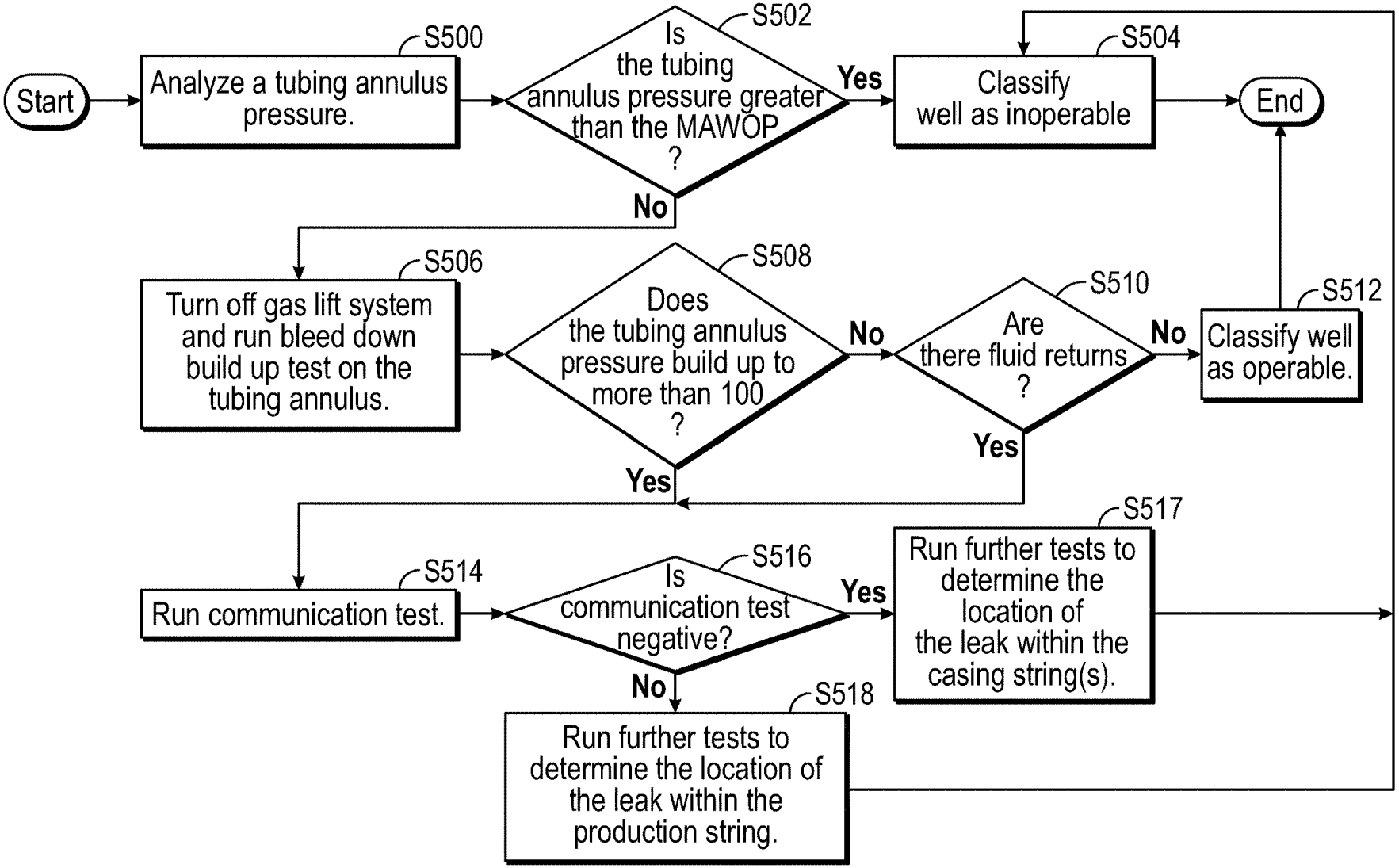
FIG. 5 shows a flowchart in accordance with one or more embodiments.

FIG. 5 depicts a flowchart in accordance with one or more embodiments. More specifically, FIG. 5 illustrates a method for determining if a well (100) is operable or inoperable based on the well's (100) tubing annulus. Further, one or more blocks in FIG. 5 may be performed by one or more components as described in FIG. 1. While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a tubing annulus pressure is analyzed (S500) by determining if the tubing annulus pressure is greater than the MAWOP (S502). If the tubing annulus pressure is greater than the MAWOP, then the well (100) may be classified as inoperable (S504). The third annulus (124) of the well (100) depicted in FIG. 1 may be the tubing annulus analyzed using the flowchart in FIG. 5. The tubing annulus pressure of the third annulus (124) may be analyzed while the gas lift operation is operating meaning gas is being injected into the third annulus (124). The tubing annulus pressure of the third annulus (124) should be equal to or greater than a gas lift-imposed annulus pressure while the gas lift is operating.

If the tubing annulus pressure is between the gas lift-imposed annulus pressure and the MWAOP and there are no fluid returns, then the well (100) may be classified as operable. If the tubing annulus pressure is between the gas lift-imposed annulus pressure and the MWAOP and there are fluid returns, then the gas lift system may be turned off and the bleed down build up test may be run on the tubing annulus (S506). The bleed down build up test is similar to the bleed down build up test described using FIG. 6 and has not been redescribed for purposes of readability. After the bleed down build up test has been run, the tubing annulus pressure is analyzed by determining if the tubing annulus pressure, i.e., the subsequent annulus pressure, builds up to more than an error pressure, such as 100 psi (S508). If the subsequent pressure does not build up to more than the error pressure, then the tubing annulus is further analyzed by determining if there are subsequent fluid returns (S510).

If there are no subsequent fluid returns, then this indicates that the initially seen tubing annulus pressure and fluid returns were the cause of thermal induced casing pressure, and the well (100) may be classified as operable (S512). If there are subsequent fluid returns or if the tubing annulus pressure does build up to a pressure of more than 100 psi with subsequent fluid returns, then a fluid sample may be taken from the fluid returns. The fluid sample may be analyzed in a lab to determine the fluid source. In accordance with one or more embodiments, the fluid sample may be analyzed using fluid fingerprinting which uses a geochemical analysis of the fluid to identify the fluid source. The fluid source may be produced fluids, shallow aquifer water, or fluids from a different reservoir. If the fluid source is determined to be from a different reservoir (i.e., not the targeted production reservoir or a shallow aquifer), then a logging tool may be run into the well to identify the location of the fluid source.

If the fluid sample indicates produced fluid returns, then a tubing casing annulus (TCA) communication test may be run (S514). The results from the TCA communication test are analyzed to determine if the TCA communication test is negative (S516). The TCA communication test includes isolating the tubing/production string (118) with a downhole plug and monitoring the pressure build up. If there is no pressure build up on the inside of the tubing/production string (118), but there is continuous pressure build up in the tubing annulus (i.e., the third annulus (124)) then there is no tubing casing communication, and the TCA communication test is negative. If there is a continuous pressure build up within the tubing/production string (118) and in the third annulus (124), then there is communication between the tubing and the casing, and the TCA communication test is positive.

If the TCA communication test is negative, then the leak is coming from one of the casing strings (112, 114, 116) and further tests need to be run to determine the specific location of the leak (S517), and the well (100) may be classified as inoperable (S504). If the TCA communication test is positive, then the leak is coming from the production string (118) and further tests (such as temperature, noise, and corrosion surveys) need to be run to determine the specific location of the leak (S518), and the well (100) may be classified as inoperable (S504). The possible locations of the production string (118) leak include a leak within the tubing hanger seal, a leak above the SSSV (126), a leak below the SSSV (126) and within the completion accessories, a leak within the gas lift mandrels (125), or a production packer (132) leak.

Expanding on S518, to determine if the leak is coming from the tubing hanger seal or from a location above the SSSV (126), the SSSV (126) is closed, and the wellhead tubing shut in pressure (WHSIP) is bled down to zero psi. If the WHSIP builds up to a value similar to the pressure seen in the tubing annulus, then this may indicate that well (100) has a leak coming from the tubing hanger seal or elsewhere along the production string (118) such as between tubing connections. To determine if the leak is coming from a location below the SSSV (126), the SSSV (126) is opened and a slickline plug is set in the landing nipple (134) below the production packer (132) within the production string (118). The WHSIP is then bled down to zero psi. If the WHSIP builds up to a value similar to the pressure seen in the tubing annulus, then the well (100) has a leak coming from a location below the SSSV (126).

Continuing with S518, to determine if the leak is coming from the gas lift mandrels (125), the SSSV (126) is opened, the slickline plug is set in the landing nipple (134), the gas lift mandrels (125) are changed out with dummy valves, and the WHSIP is bled down to zero psi. If the WHSIP builds up to a value similar to the pressure seen in the tubing annulus, then the well (100) has a leak coming from the gas lift mandrels (125) and a special temperature survey, taken while the well (100) is flowing, is employed to specify which gas lift mandrel (125) the leak is coming from. To determine if the leak is coming from the production packer (132), the SSSV (126) is opened, the slickline plug is set in the landing nipple (134), and the WHSIP is bled down to zero psi. If the WHSIP remains at zero psi, then bleed down the tubing annulus pressure to zero psi. If the tubing annulus pressure builds up to a similar value as before, then the well (100) has a leak coming from the production packer (132).

Expanding on S517, to determine if the leak is coming from one of the casing strings (112, 114, 116), the TCA communication test may show a negative result and a temperature survey, corrosion log, and production log may be run on the well (100). If the temperature survey shows a temperature anomaly across shallow aquifer formations, the corrosion log shows corrosion within the outer/shallower casing strings (112, 114), and/or the fluid samples identify the fluid source being formation water, then the well (100) has a leak coming from one of the outer/shallower casing strings (i.e., the surface casing (112) or the intermediate casing (114)). If the temperature survey shows a temperature anomaly across sub reservoir layers, the corrosion log shows corrosion within the production casing (116), a production log shows downhole cross flow between sub-reservoir layers, and/or the fluid samples identify the fluid source as being hydrocarbons, then the well (100) has a leak coming from the production casing (116) below the production packer (132).

Figure 7:
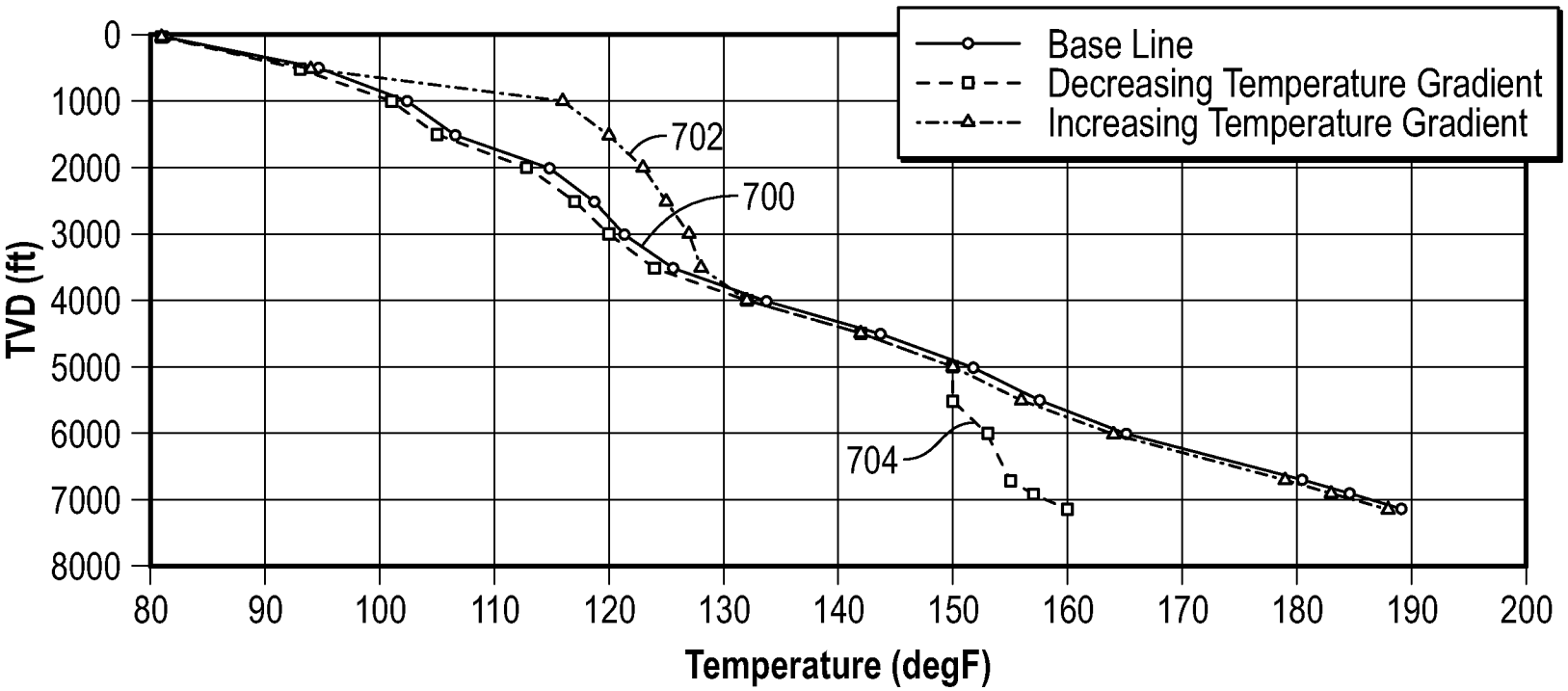
FIG. 7 shows a casing leak detection and temperature profiling graph in accordance with one or more embodiments.

FIG. 7 depicts a temperature survey showing two different temperature anomaly trends. The temperature survey plots depth vs. temperature within a well (100). FIG. 7 shows three trends, a base line (700), an increasing temperature gradient (702), and a decreasing temperature gradient (704). The base line (700) shows what a well (100) with no casing leaks may look like. The increasing temperature gradient (702) shows that, for the well (100) surveyed, there may be a leak in one of the outer/shallower casing strings (i.e., the surface casing (112) or the intermediate casing (114)), and the decreasing temperature gradient (704) shows that there may be a leak in the production casing (116) for the well (100) surveyed.

Methods outlined in FIGS. 2-5 were described sequentially; however, they may be performed simultaneously or in any suitable order. That is, any of the tests discussed above may be performed before or after any of the other tests described above. A well (100) being analyzed by the well integrity program outlined in FIGS. 2-5 may be classified as inoperable if just one category is deemed inoperable. In this case, the inoperable well is secured, put offline, and scheduled for a workover operation. Further, the methods described herein used the well (100), described in FIG. 1, as an example well, however any well with any number of casing strings may be used without departing from the scope of this disclosure. In one or more embodiments, the well integrity program outlined in FIGS. 2-5 may be repeated on a well on an annual, bi-annual, or any other timing basis to ensure the well is operable.

Further, embodiments disclosed herein analyze the integrity of Christmas tree and wellhead assembly valves for gas lift wells to maintain well integrity and safety for gas lift wells, maintain gas lift well productivity, maximize the operation life of a gas lift well, identify tubing leaks, resolve the uncertainty related to well integrity conditions, generate a cost effective approach by excluding downhole intervention, prevent oil spills and environmental impact, prevent risks related to well blowouts and assets damage, prevent underground fluid invasion into water aquifers, avoid downhole cross flow between multi-oil bearing reservoirs, prevent formation damage due to dumping water into oil bearing reservoirs, and minimize hydrocarbon leaks which may jeopardize a production platform.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A method for well integrity management on a well having at least one casing annulus, the method comprising:

analyzing an annulus pressure in the at least one casing annulus, wherein the well is a gas lift well comprising a gas lift mandrel;

running a bleed down build up test on the at least one casing annulus when the annulus pressure is between an error pressure and a maximum allowable working operating pressure;

analyzing a subsequent annulus pressure after the bleed down build up test;

determining a presence of fluid returns after the bleed down build up test; and classifying the well as operable or inoperable based on the annulus pressure, the subsequent annulus pressure, and the fluid returns.

2. The method of claim 1, wherein the well is classified as inoperable when the annulus pressure of the at least one casing annulus is greater than the maximum allowable working operating pressure.

3. The method of claim 1, wherein the well is classified as operable when the annulus pressure of every casing annulus is less than the error pressure.

4. The method of claim 1, wherein the error pressure comprises a pressure reading of less than 100 psi and the maximum allowable working operating pressure comprises a maximum pressure value of a weakest component of a pressure vessel of the well.

5. The method of claim 4, wherein the well is classified as inoperable when the subsequent annulus pressure of the at least one casing annulus is greater than the error pressure.

6. The method of claim 4, wherein the well is classified as inoperable when the subsequent annulus pressure of the at least one casing annulus is less than the error pressure, and the at least one casing annulus has fluid returns.

7. The method of claim 4, wherein the well is classified as operable when the annulus pressure or the subsequent annulus pressure of every casing annulus is less than the error pressure, and every casing annulus does not have fluid returns.

8. A method for well integrity management on a well having a tubing annulus, the method comprising:

injecting gas into the tubing annulus via a gas lift mandrel;

analyzing an annulus pressure in the injected tubing annulus;

running a bleed down build up test on the tubing annulus when the annulus pressure is less than a maximum allowable working operating pressure;

analyzing a subsequent annulus pressure after the bleed down build up test;

determining a presence of fluid returns after the bleed down build up test;

running a communication test between the tubing annulus and a casing annulus when the subsequent annulus pressure is greater than an error pressure; and classifying the well as operable or inoperable based on the annulus pressure, the subsequent annulus pressure, the fluid returns, and the communication test.

9. The method of claim 8, wherein the well is classified as inoperable when the annulus pressure of the tubing annulus is greater than the maximum allowable working operating pressure.

10. The method of claim 8, wherein the error pressure comprises a pressure reading of less than 100 psi.

11. The method of claim 8, wherein the communication test is run on the well with the tubing annulus having the subsequent annulus pressure less than the error pressure and having fluid returns.

12. The method of claim 8, wherein the well is classified as operable when the subsequent annulus pressure is less than the error pressure and there are no fluid returns.

13. The method of claim 8, wherein the well is classified as operable when the communication test is negative.

14. The method of claim 8, wherein the well is classified as inoperable when the communication test is positive.

* * * * *